US006050281A

United States Patent [19]

Adams et al.

[11] Patent Number: 6,050,281

[45] Date of Patent: Apr. 18, 2000

[54] FAIL-SAFE GAS VALVE SYSTEM WITH SOLID-STATE DRIVE CIRCUIT

[75] Inventors: John T. Adams, Minneapolis; Bruce L. Hill, Roseville; Rolf L. Strand, Crystal, all of Minn.

[73] Assignee: Honeywell Inc., Minneapolis, Minn.

[21] Appl. No.: 08/884,537

[22] Filed: Jun. 27, 1997

[51] Int. Cl.[7] ..... F16K 31/02

[52] U.S. Cl. ..... 137/1; 251/129.01; 137/613; 361/152; 361/189

[58] Field of Search ..... 251/129.01; 361/152, 361/189; 137/613, 1

[56] References Cited

U.S. PATENT DOCUMENTS 4,865,538 9/1989 Scheele et al. ..... 431/18

5,085,574 2/1992 Wilson ..... 251/129.01 X

*Primary Examiner*—Kevin Lee

*Attorney, Agent, or Firm*—Charles L. Rubow

[57] ABSTRACT

A solid-state fail safe gas valve system in which first and second gas valves are arranged in series in a gas passageway, the valves being actuatable by first and second solenoid operators respectively, the second operator requiring a voltage greater than the operating voltage supplied to the valve system to achieve actuation. The operators are separately energized through microprocessor controlled switches so that a capacitor connected across the second operator and its switch is pumped to a voltage above the supplied voltage by voltage induced by interrupted energization of the first operator.

8 Claims, 3 Drawing Sheets

FAIL-SAFE GAS VALVE SYSTEM WITH SOLID-STATE DRIVE CIRCUIT

BACKGROUND OF THE INVENTION

The present invention relates generally to fuel supply and control apparatus for gas burners. More specifically, it relates to a gas valve system of the type having solenoid operated pilot and main valves and an electronic control circuit for achieving fail-safe gas flow control.

Fuel gas valves of the type having a pilot valve and a main valve are used in many applications. In the residential market, for example, gas fueled space heaters, water heaters, stoves, and ovens commonly use a pilot valve/main valve arrangement as these devices are typically operated only intermittently. For environmental and economic reasons, recent designs of these systems include electronic ignition of a pilot burner when use is called for, rather than continuous burning of the pilot flame.

It is obviously desired to use gas system components which reduce as much as possible the risk of explosions and/or other hazards resulting from unintended gas release. One common level of protection against such occurrences is to employ a valve design in which the main valve is arranged in series with the pilot valve. This assures that there can be no gas flow through the main burner if gas is not available to the pilot burner. A second level of protection can be provided by testing for the actual existence of or proving the pilot flame with a thermocouple or other device. In such an approach, a signal from the thermocouple causes the actuation of the main valve only when the pilot flame has been proved.

Fail-safe operation of the above arrangements, however, depends on proper operation of the electronic and/or electrical controls. A worn or broken relay may, for example, open a valve or hold open a valve when such a result is unwanted. In response to these concerns, redundant parts or relay logic may be used to prevent unintended gas release caused by failure of components in the gas valve system.

Fail-safe systems which utilize relays and/or redundant mechanical parts, however, suffer from larger size and increased cost. Relay logic also consumes an undesirably large amount of power for operation. A further problem with such systems relates to long term reliability and operability. Mechanical components are more prone to deterioration and failure, and hence likely to have a shorter useful life than functionally equivalent solid state implementations.

Solid-state control systems address many of the disadvantages of mechanical control systems. Specifically, solid-state systems require less operating power and generally have longer functional lifetimes. Furthermore, solid-state devices tend to be smaller and less costly to build.

Use of solid-state gas valve control systems with fail-safe mechanisms have been addressed in a number of patents. For example, U.S. Pat. No. 5,085,574(Wilson), describes a solid-state, fail-safe gas valve system in which failure of any single part in the safety circuit prevents actuation of a gas valve. U.S. Pat. No. 4,865,538(Scheele etal.) describes another solid-state, fail-safe gas valve which discriminates against false enabling signals such as a direct current signal, line voltage signal, or non-repetitive alternating current signal.

Both patents prevent actuation of the controlled valve due to system failure by using an intermediate charge-storing device and a switching means. The switching means is situated to prevent current flow from the charge storage device to the valve without proper operation of each part in the control system. Neither patent, however, suggests how to apply the method described to a pilot valve/main valve system.

The present system overcomes the disadvantages discussed above in known fail-safe main valve/pilot valve systems. It provides a cost-effective, solid-state, fail-safe gas valve drive circuit which eliminates problems with mechanical relay failure and the higher initial and maintenance costs of electromechanical relay based approaches. Further, it requires less operating power, in part because there is no requirement for power to maintain relay actuation.

SUMMARY OF THE INVENTION

The invention described herein is fail-safe gas valve system, and a method for implementing the same. Apparatus in accordance with the invention includes first and second gas valves, respectively operated by first and second actuator coils. The valves are designed to require greater current for actuation than is required for maintenance in the actuated state. At least one of the actuator coils is connected in series with a switch, which is preferably of solid-state form. Supply conductors are provided to supply a generally unipolar voltage sufficient to actuate at least the first actuator coil. The switch is adapted to receive a control signal which will actuate one of the coils, and will maintain actuation of both coils by causing current to be alternately to one coil and then the other.

A charge storing means may be provided to alternate with the supply conductors in supplying current to the second coil. Use of the charge storing means provides an added measure of safety if the second coil is used requires a larger voltage for actuation than is available on the conductors. In such a system, a second switch means allows current to flow from the charge storing means to the second actuator coil only after the charge storing means is charged to a voltage sufficient to actuate the valve.

The method of the present invention basically comprises the steps of (1) supplying a unipolar voltage to a first coil of sufficient magnitude to actuate a first coil, and (2) reducing the duty cycle of the unipolar voltage enough to cause and maintain actuation of a second coil, without de-actuating the first coil. Actuation may occur after a predetermined number of periods, by temporarily causing current to flow into a charge storage means until the charge storage means can supply current at sufficient voltage to actuate the second coil.

DESCRIPTION OF THE PREFERRED EMBODIMENT

Figure 1:
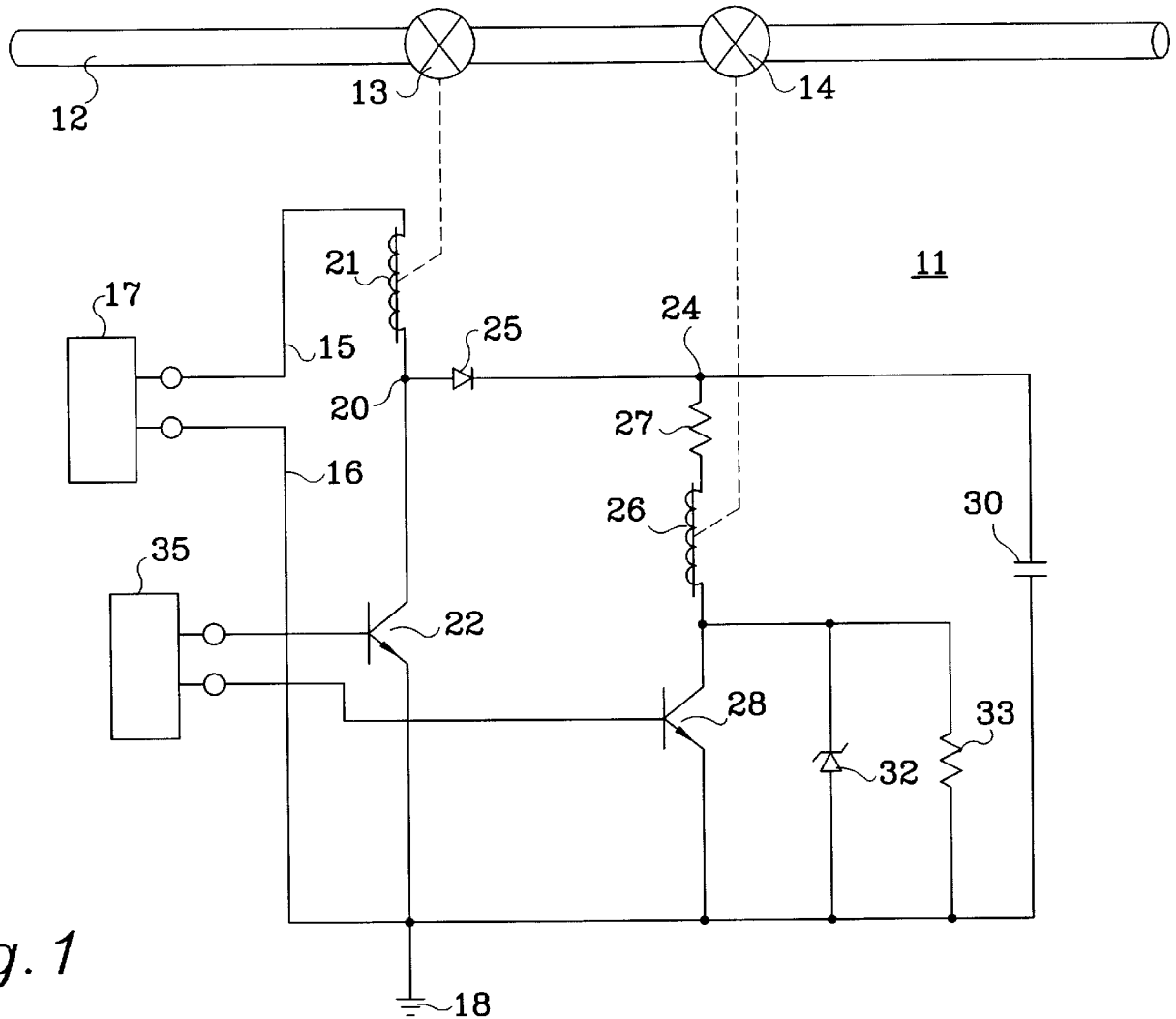
FIG. 1 is a schematic diagram of a preferred embodiment of a gas valve system in accordance with the applicants' invention.

With reference to the schematic diagram of FIG. 1, reference numeral 11 generally identifies fuel gas valve apparatus having a gas passageway 12 therethrough, flow through passageway 12 being controlled by first and second solenoid operated valves 13 and 14 arranged in series. In this embodiment, first and second valves 13 and 14 may be considered and referred to as pilot and main valves, respectively.

Reference numerals 15 and 16 identify power supply conductors for supplying electric current from a source 17 at a substantially unipolar voltage to a valve control system which controls the operation of valves 13 and 14. Source 17 may include a transformer and rectifier bridge. In a typical gas valve system, the transformer may supply current at a nominal voltage of 24 volts AC, and source 17 will include various additional switches and circuits for achieving desired safety, timing and sequencing functions. Conductor 16 may be maintained at a system reference potential or ground as indicated at reference numeral 18.

Various elements of the valve control system are interconnected at a first node identified by reference numeral 20. Specifically, an actuator coil 21 of a solenoid operator for valve 13 is connected between conductor 15 and node 20. Node 20 is connected to conductor 16 through a first NPN transistor 22 which serves as a first solid-state switch. Node 20 is also connected to a second interconnection node 24 through a diode 25 oriented to permit current flow toward node 24. One end of an actuator coil 26 of a solenoid operator for valve 14 is connected to node 24 through a resistor 27, and to conductor 16 through a second NPN transistor 28 serving as a second solid state switch.

An energy storage device in the form of a capacitor 30 is connected between conductor 16 and node 24. A Zener diode 32 and a resistor 33 are each connected across the emitter-collector electrodes of transistor 28. The control signals for transistors 22 and 28 are supplied by a control circuit 35 which is preferably implemented with a microprocessor to produce control signals characterized as described hereinafter.

Operation of fuel valve apparatus 11 and the fail-safe features thereof depend on shuttling of energy between actuator coils 21 and 26. According, the supply voltage, characteristics of coils 21 and 26 and the size of capacitor 30 must be properly interrelated. Actuator coils 21 and 26 each require a larger current therethrough, corresponding to a larger voltage thereacross, to achieve the ampere turns required for actuating the associated valve from an unactuated state than is required for maintaining the valve in an actuated state. Assuming that source 17 includes a transformer of which the secondary winding produces 24 volts AC which is rectified to produce a unipolar voltage having an RMS valve of approximately 27 volts on conductor 15, coil 21 must be characterized to achieve actuation at not over 100% duty cycle application of the voltage on conductor 15. However, it is sufficient that application of the same voltage at 50% duty cycle will maintain actuation. In an actual embodiment, coil 21 was designed to achieve actuation at 18 volts RMS, and to maintain or hold actuation at six volts RMS.

Actuator coil 26 is characterized to require a substantially higher voltage, for example, 48 volts, to achieve actuation. Conversely, a voltage of 6 volts RMS across coil 26 is sufficient to hold the valve in an actuated state. For reasons which will be discussed hereinafter, in the exemplary embodiment coil 26 is characterized to require one-half the ampere turns for its hold state than the ampere turns required to hold coil 21 in an actuated state. This is achieved in the exemplary embodiment by forming coil 21 of 2,925 turns of number 30 wire and forming coil 26 of 6,000 turns of number 36 wire.

The following is a general description of the operation of gas valve apparatus 11. Opening of the valve apparatus is initiated by turning transistor 22 ON for a sufficient time to actuate solenoid 21. Transistor 22 is then cycled ON and OFF to cause coil 21 to pump charge through diode 25 to charge the capacitor 30 to a voltage sufficient for coil 26 to achieve actuation. The voltage on capacitor 30 is limited by the breakdown voltage of Zener diode 32 plus the voltages across coil 26 and resistor 27. In the exemplary embodiment, capacitor 30 is charged to approximately 65 volts.

The operating duty cycle of transistor 22 during the pumping interval must be sufficiently high to hold the actuated state of coil 21 with capacitor 30 charged to its maximum voltage. In the present example, a duty cycle of 90% is sufficient to achieve this result.

After a pumping interval sufficient to charge capacitor 30 to the maximum voltage permitted by Zener diode 32, transistor 28 is turned ON to energize coil 26 by discharging capacitor 30 through the coil. Resistor 27 functions to limit the discharge rate of capacitor 30 through coil 26 so that a smaller capacitor may be used with coil 26 formed to be maintained in an actuated state with one-half the ampere turns required to maintain coil 21 in an actuated state.

Thereafter, the operating duty cycle of transistor 22 is reduced to 50% which is sufficient to maintain coil 21 in an actuated state. During this interval, each time transistor 22 is turned OFF, coil 21 induces a voltage at node 20 which causes sufficient current to flow through diode 25 to node 24 to maintain coil 26 in an actuated state. During the portion of each cycle when transistor 22 is turned ON, solenoid 26 continues to be maintained in an actuated state by discharge of capacitor 30 and current induced in coil 26 by decay of the magnetic field surrounding the coil.

Figure 2:
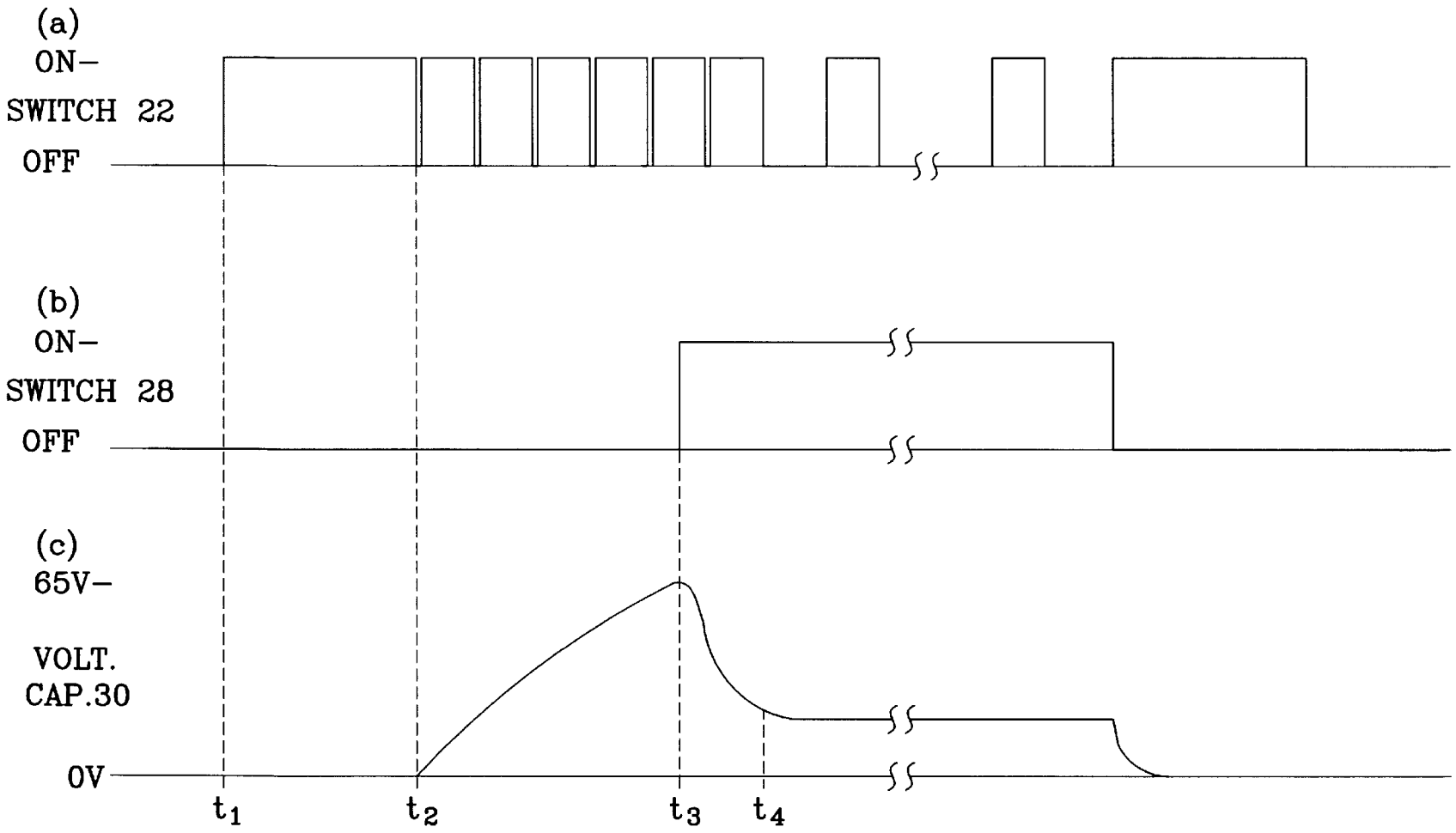
FIG. 2 illustrates representative waveforms associated with operation of the gas valve system of FIG. 1.

As shown in the waveforms of FIG. 2 which illustrate operation of gas valve apparatus 11, when gas flow is commanded, transistor 22 is turned ON at time $t_1$ and remains on solid for an interval extending to time $t_2$ which interval is sufficient to achieve actuation of coil 21. At time $t_2$, control circuit 35 is programmed to cycle transistor 22 ON and OFF at a 90%–10% duty cycle for an interval extending to time $t_3$ which is sufficient to charge capacitor 30 from zero volts to the maximum voltage permitted by Zener diode 32. In the present example, this occurs in about one-half second. Transistor 28 is then switched ON, allowing capacitor 30 to be discharged through coil 26 to actuate the solenoid. This results in reduction of the voltage on capacitor 30 to about 20 volts in a few tens of micro-seconds as indicated at time $t_4$. Valves 13 and 14 are then both open, and the gas valve apparatus is operating in a run mode. During the run mode, the voltage of approximately 20 volts is maintained on capacitor 30 by cycling transistor 22 ON and OFF at a 50% duty cycle, which voltage is sufficient to maintain coil 26 in an actuated state.

When it is desired to terminate gas flow through valves 13 and 14, transistor 28 is first turned OFF, which causes valve 14 to close. At that time, it may also be desirable to cease cycling transistor 22 ON and OFF, and maintain it in a solid ON state for a short interval. Under these conditions, no charge is pumped into capacitor 30 by coil 21. Further, resistor 33 functions to completely discharge capacitor 30. Transistor 22 is then turned off, which de-energizes coil 21, thereby closing valve 13.

It can be seen that this apparatus is fail-safe in that any combination of opened or shorted circuit components will not cause coil 26 to become or remain actuated.

Figure 3:
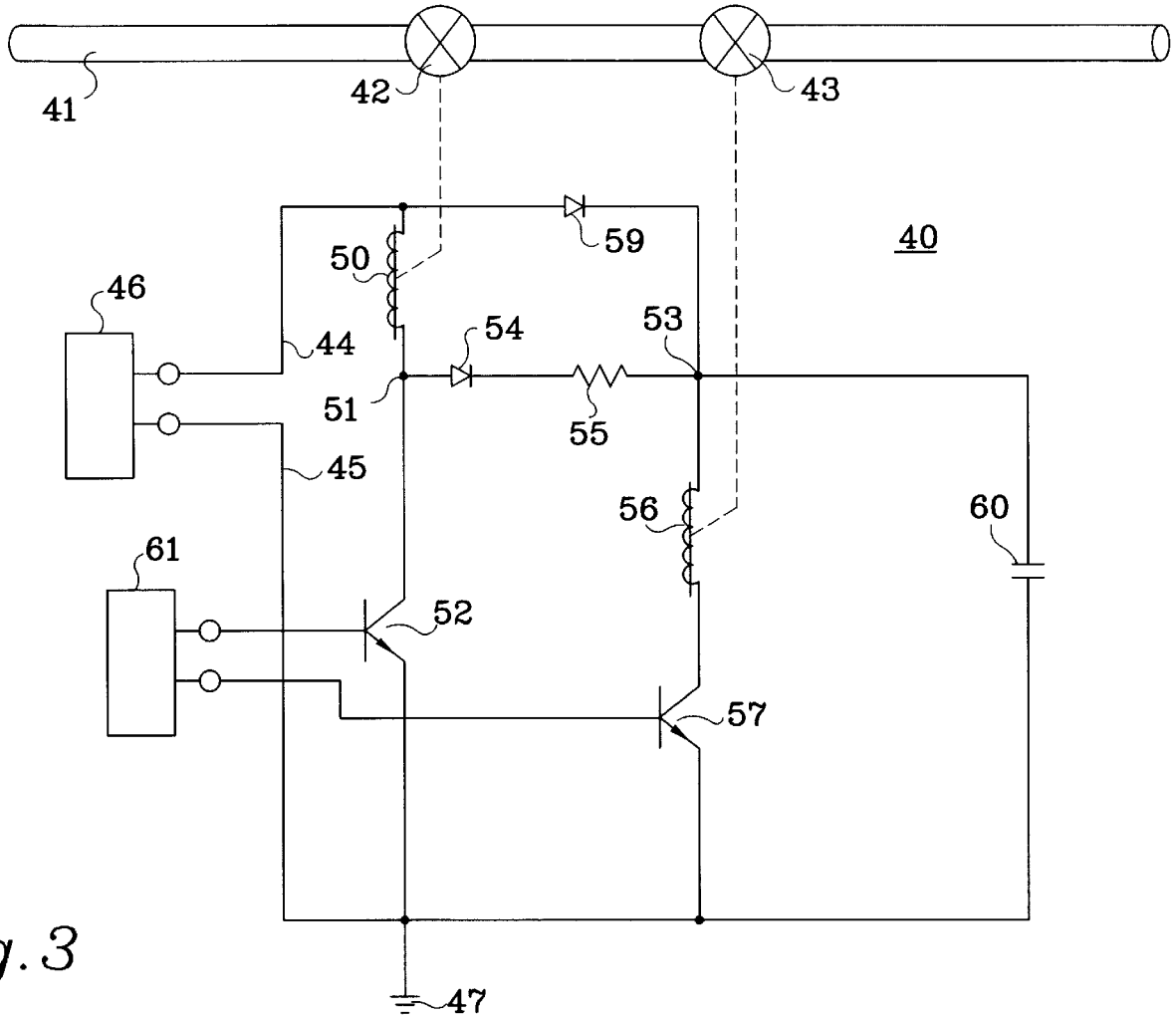
FIG. 3 is a schematic diagram of an alternative embodiment of the applicants' gas valve system.

The gas valve apparatus of FIG. 3 differs somewhat from the gas valve apparatus of FIG. 1 in circuit configuration, circuit component characteristics and operating control characteristics. In FIG. 3, the gas valve apparatus is generally identified by reference numeral 40. As in gas valve apparatus 11, gas valve apparatus 40 includes a gas passageway 41 through which gas flow is controlled by first and second solenoid operated valves 42 and 43 arranged in series. In this embodiment, first and second valves 42 and 43 may be considered and referred to as main and pilot valves, respectively.

Reference numerals 44 and 45 identify power supply conductors for supplying electric current from a source 46 at a substantially unipolar voltage to a valve control system which controls operation of valves 42 and 43. In this embodiment, source 46 may be considered as supplying on conductor 44 a positive voltage derived from rectifying a 24 volt alternating current. As indicated at reference numeral 47, conductor 45 is maintained at system reference potential or ground.

An actuator coil of a solenoid operator for valve 42 is identified by reference numeral 50. Coil 50 is connected between conductor 44 and a first node 51. A first NPN transistor or solid state switch 52 is connected between node 51 and conductor 45. Node 51 is connected to a second interconnection node 53 through a series connected diode 54 and resistor 55. Diode 54 is oriented to permit current flow toward node 53.

An actuator coil 56 of a solenoid operator for valve 43 is connected in series with a second NPN transistor or solid state switch 57 between node 53 and conductor 45. A diode 40 is connected between conductor 44 and node 53, and is poled to permit current flow toward node 53. An energy storage capacitor 60 is connected between node 53 and conductor 45.

As in gas valve apparatus 11, actuator coils 50 and 56 require a larger voltage thereacross for actuation from an unactuated state than for maintenance in an actuated state. Coil 50 is designed for operation from a 24 volt unipolar current source. Coil 56 is designed to require a much larger voltage, for example, 120 volts DC for actuation from an unactuated state. Safety is achieved, in part, because a 24 volt supply alone cannot produce the voltage required for coil 56 to achieve actuation. The higher voltage required for coil 56 to achieve actuation is produced by cycling transistor 52 ON at a low duty cycle, e.g., 10%, which is low enough to ensure that coil 50 does not open valve 42. As transistor 52 is turned off, the inductive kick generated by coil 50 boosts the voltage on capacitor 60 increasingly further above the voltage on conductor 44 which is normally maintained on capacitor 60 through diode 59. When the voltage across capacitor 60 reaches a voltage sufficient for coil 56 to achieve actuation, transistor 57 may be turned ON. This allows capacitor 60 to discharge through coil 56 and open valve 43. Transistor 52 can then be turned ON continuously, which will energize coil 50 sufficiently to open valve 42.

Safety is achieved by the requirement that both transistors 52 and 57 operate properly and in the indicated modes. Otherwise, the voltages supplied to coils 50 and 56 are not sufficient to actuate the associated solenoids.

Although two specific embodiments of gas valve apparatus in accordance with the applicants' invention have been shown and described for illustrative purposes, other embodiments and variations within the applicants' contemplation and teaching will be apparent to those of ordinary skill in the relevant arts. It is not intended that coverage be limited to the disclosed embodiments, but only by the terms of the following claims.

The embodiment of the invention in which an exclusive property or right is claimed are defined as follows:

1. In gas valve apparatus of the type having first and second valves arranged in series and operated by first and second electrically energizable actuator coils respectively, the first and second actuator coils requiring greater current for actuation from an unactuated state than for maintenance in an actuated state, one of said first and second actuator coils requiring a greater current for actuation then the other coil, the improvement which comprises:

first and second conductors for supplying electric current at a substantially unipolar voltage between said conductors, the unipolar voltage, when uninterrupted for at least a predetermined time interval, being sufficient to produce electric current through the first actuator coil adequate to actuate the first valve;

first and second interconnection nodes;

a unidirectional current element connecting said first and second interconnection nodes, and operable to permit current flow toward said second interconnection node;

first connecting means connecting the first actuator coil between said second conductor and said first interconnection node;

second connecting means connecting the second actuator coil between said second interconnection node and said first conductor;

an energy storage device connected between said second interconnection node and said first conductor; and electrically controllable switch means connected between said first conductor and said first interconnection node, adapted to receive a control signal which causes said electrically controllable switch means to allow current to flow through the first actuator coil during a first predetermined time interval adequate to actuate the first valve from an unactuated state, and causes said electrically controllable switch means to chop the current flowing through the first actuator coil at a duty cycle adequate to maintain the first valve in an actuated state but inadequate to actuate the first valve from an unactuated state, during a second time interval.

2. The gas valve apparatus of claim 1 further comprising:

a microprocessor which supplies the control signals for causing said electrically controllable switch means to allow current at an uninterrupted unipolar voltage to flow through the actuator coil of said first valve during the first predetermined time interval, adequate to actuate the first valve from an unactuated state, and causing said electrically controllable switch means to chop the current flowing through the first actuator coil at a duty cycle adequate to maintain the first valve in an actuated state, but inadequate to actuate the first valve from an unactuated state, during a second time interval.

3. A gas valve apparatus for providing fail-safe gas supply comprising:

first and second conductors for supplying electric current at a substantially unipolar voltage between said conductors;

a first interconnection node;

a first valve, operated by an electrically energizable actuator coil, said first valve requiring a greater current for actuation from an unactuated state than for maintenance in an actuated state, and requiring a voltage for actuation no greater than the voltage to be supplied at said conductors;

a first switch means, adapted to receive a control signal for causing said first switch means to allow continuous current to flow through the actuator coil of said first valve for a sufficient duration to actuate said first valve during one period, causing said first switch means to allow intermittent current to flow through the actuator coil of said first valve of sufficient duration to maintain actuation of said first valve but not of sufficient duration for actuation of said first valve during a second period, and to allow intermittent current to flow through the actuator coil of said first valve of sufficient duration to maintain actuation of said first and second valves during a third period;

a first series connection, including at least said first switch means and the actuator coil of said first valve, connected between said first and second conductors, said first interconnection node serving as a junction between said first switch means and the actuator coil of said first valve;

a second valve operated by an electrically energizable actuator coil, said second valve requiring a larger current for actuation from an unactuated state than for maintenance in an actuated state, said second valve requiring voltage for actuation greater than the voltage to be supplied at said conductors;

a second interconnection node;

a charge storage means connected between said second interconnection node and said second conductor, capable of supplying electric current at a voltage sufficient to actuate said second valve to the open state;

a second switch means adapted to receive a control signal for causing said second switch means to allow current flow through the actuator coil of said second valve when said capacitor can supply electric current at a voltage sufficient to actuate said second valve to the open state;

a second series connection, connected in parallel with said charge storage means, including at least said second switch means and the actuator coil of said second valve;

a connection means, connecting said first interconnection node to said second interconnection node, including at least a current limiting means, the current limiting means being polled to provide current flow from said first interconnection node to said second interconnection node.

4. The gas valve apparatus of claim 3 wherein:

a current limiting means is connected in parallel with said second switch means.

5. The gas valve apparatus of claim 4 wherein:

said current limiting means comprises at least a Zener diode and resistor connected in parallel.

6. The gas valve apparatus of claim 5 further comprising:

a microprocessor which supplies the control signals for causing said first switch means to allow continuous current to flow through the actuator coil of said first valve for a sufficient duration to actuate said first valve during one period, causing said first switch means to allow intermittent current to flow through the actuator coil of said first valve of sufficient duration to maintain actuation of said first valve but not of sufficient duration for actuation of said first valve during a second period, and to allow intermittent current to flow through the actuator coil of said first valve of sufficient duration to maintain actuation of said first and second valves during a third period.

7. The gas valve apparatus of claim 3 wherein:

a second connection means, including a second current limiting means, is connected between said first supply conductor and said second interconnection node, the second current limiting means being poled to provide current flow away from said first conductor.

8. A method of operating a valve apparatus of the type having first and second actuator coils, both of which must be electrically energized to maintain the valve apparatus in an open condition, the first actuator coil exhibiting greater inductance than the second actuator coil, the first actuator coil also requiring an actuation current of at least a first magnitude therethrough for actuation from an unactuated state and a maintenance current of at least a second magnitude less than the first magnitude for maintenance in an actuated state, the second actuator coil requiring a current having a third magnitude less than the first magnitude for actuation and maintenance in an actuated state, the method comprising the steps of:

supplying a first unidirectional electric current of at least the first magnitude to the first actuator coil for a sufficient interval of time to actuate the first actuator coil from an unactuated state;

after the first interval of time, periodically interrupting the electric current supplied to the first actuator coil so that the average magnitude of the electric current supplied to the first actuator coil is less than the first magnitude and at least as great as the second magnitude, the first actuator coil, upon interruptions of the electric current supplied thereto, generating a self-induced voltage thereacross; and applying the voltage induced across the first actuator coil to the second actuator coil, whereby electrical energization sufficient to maintain both the first and second actuator coils in an actuated state is provided as long as the periodically interrupted electric current is supplied to the first actuator coil.

* * * * *